United States Patent [19]

Hara

[11] 4,411,141

[45] Oct. 25, 1983

[54] PARALLEL OPERATION COMPRESSOR TYPE REFRIGERATING APPARATUS

[75] Inventor: Akira Hara, Wakayama, Japan

[73] Assignee: Mitsubishi Denki Kabushiki Kaisha, Tokyo, Japan

[21] Appl. No.: 335,662

[22] Filed: Dec. 30, 1981

[30] Foreign Application Priority Data

Feb. 6, 1981 [JP] Japan ..... 56/17102

[51] Int. Cl.[3] ..... F25B 43/02

[52] U.S. Cl. ..... 62/468; 62/510; 417/427; 417/428; 418/97

[58] Field of Search ..... 62/84, 468, 469, 470, 62/471, 510; 418/97; 417/427, 428

[56] References Cited

U.S. PATENT DOCUMENTS

| | | | |
|---|---|---|---|
| 2,677,944 | 5/1954 | Ruff | 62/468 |
| 2,684,579 | 7/1954 | Hieatt et al. | 62/468 |
| 3,360,958 | 1/1968 | Miner | 62/470 |
| 3,386,262 | 6/1968 | Hackbart et al. | 62/469 |
| 3,503,223 | 3/1970 | Parker | 62/510 |
| 3,581,519 | 6/1971 | Garrett, Jr. et al. | 62/468 |
| 3,621,670 | 11/1971 | Kinney | 62/468 |
| 3,633,377 | 1/1972 | Quick | 62/468 |
| 3,719,057 | 3/1973 | Grant | 62/510 |
| 3,775,995 | 12/1973 | Gonley et al. | 62/510 |
| 3,785,169 | 1/1974 | Gylland, Jr. | 62/468 |
| 4,179,248 | 12/1979 | Shaw | 62/510 |

OTHER PUBLICATIONS

Ashrae Systems Handbook, 1976, Chapter 26, System Practice for Halocarbon Refrigerants.

Catalogue of AC & R Components, Inc. of Chicago, IL, Oil Control Systems, 1973.

*Primary Examiner*—Ronald C. Capossela

*Attorney, Agent, or Firm*—Wenderoth, Lind & Ponack

[57] ABSTRACT

A parallel operation compressor type refrigerating apparatus is disclosed which has first and second compressors connected in parallel with each other by a pipe, each having the inside of its crankcase separated into a motor chamber and a compressing element chamber by a partition provided with a pressure equalizing opening and a lubricant equalizing nonreturn valve allowing lubricant passage only from the motor chamber side to the compressing element chamber side, and which comprises a means provided at the end of a suction pipe of a refrigeration cycle system to separate the refrigerant gas circulating within the suction pipe into a lubricant and a gas, a first branch pipe to supply a portion of said gas to the first compressor, a second branch pipe to supply the rest of the gas and the lubricant to the second compressor, a pressure and lubricant equalizing pipe connecting together the lubricant sinks of the two compressors, and a nonreturn valve provided in the pressure and lubricant equalizing pipe to block the gas flow from the first to the second compressors.

4 Claims, 1 Drawing Figure

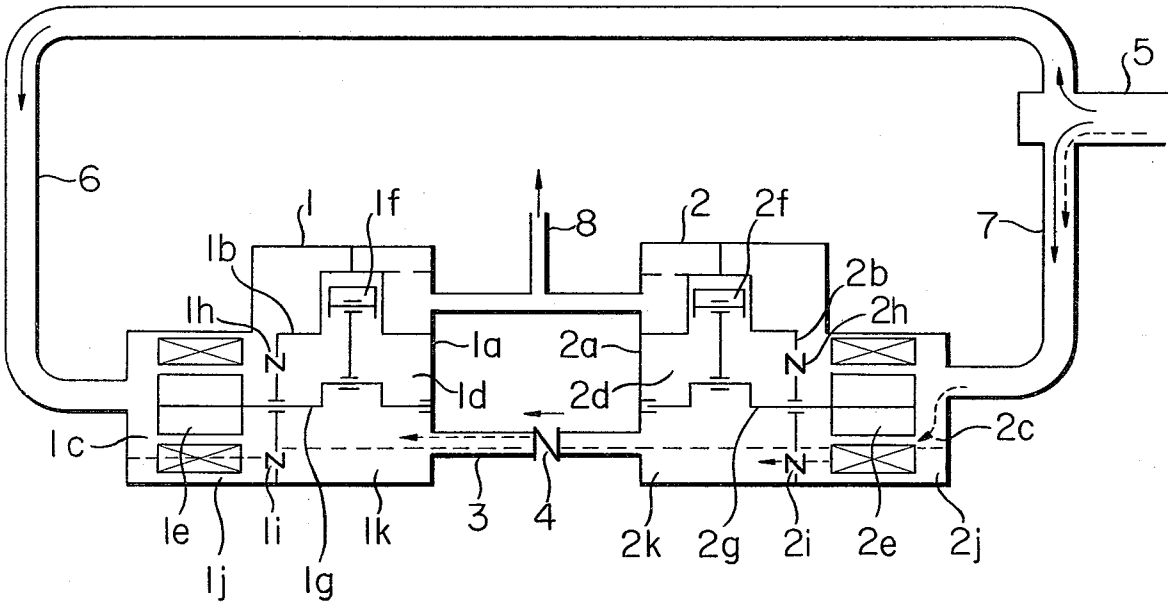
5
7
2c
2j
2b
2h
2e
2f
2i
2g
2
2k
8
2a
2d
4
3
1a
1d
1f
1k
1g
1
1b
1h
1i
1j
1e
1c
6

PARALLEL OPERATION COMPRESSOR TYPE REFRIGERATING APPARATUS

BACKGROUND OF THE INVENTION

The present invention relates to a refrigerating apparatus and more particularly to a parallel operation compressor type refrigerating apparatus comprising compressors operable in parallel with each other, wherein the lubricant levels in the compressors are always maintained appropriately equal regardless of whether the compressors are operated in parallel with each other or any one of them is operated singularly.

Hitherto, in a parallel compression type refrigerating apparatus comprising two compressors, a pressure and lubricant equalizing pipe has been provided between the two compressors and adapted to always keep the compressors in communication with each other during the operation of the compressors, whether that operation be parallel or singular. As a result, in a semi-hermetically sealed refrigerating machine in which a suction element chamber and a compressing element chamber are separated by a partition, since during a singular operation a pressure is applied to the compressing element chamber of the compressor which is in operation through a suction pipe, a motor chamber, the compressing element chamber, and the pressure and lubricant equalizing pipe of the compressor which is not in operation, a lubricant equalizing nonreturn valve in the compressor which is in operation is closed so that the lubricant returned into the suction chamber cannot be returned into the compressing element chamber, making it difficult to maintain the lubricant level in a compressing element chamber at a normal level, so that seizure of the shifting portions of the compressor due to a shortage of the lubricant thereto, a decrease in refrigeration capacity due to excessive lubricant content in the compressor which is in operation, damage of valve portions due to the compression of the lubricant, etc. may occur.

There is a solution to prevent excessive lubricant during the partial operation of the compressors. It is to mount a lubricant separator at the discharge side of the compressor to separate the lubricant oil contained in the discharged gas, returning the separated lubricant oil to the compressor. However, this known procedure has various defects, such as that the lubricant at a high temperature raises the lubricant temperature in the crankcase when the former returns there, and that when the compressor is started again after a standstill of a long time condensed liquid refrigerant in the lubricant separator at a low temperature is returned to the compressor to foam the lubricant, resulting in deterioration of the lubrication, etc. Moreover, due to a slight difference in capacity between the two compressors and a difference in the pipe friction of the suction pipes, a differential pressure is generated between the compressing element chambers of the two compressors so that a tendency for the lubricant levels not to be equal develops. There is also another defect, i.e. since the lubricant level is hard to observe through a sight glass, maintenance is difficult.

SUMMARY OF THE INVENTION

It is a primary object of the present invention to provide a parallel operation compressor type refrigerating apparatus which can overcome the various abovementioned defects inherent in conventional refrigerating apparatuses of this type.

It is another object of the present invention to provide a parallel operation compressor type refrigerating apparatus which allows a stable operation for a long period of time without the fear of seizure of the relatively shifting parts of the compressor regardless of whether the two compressors are operated simultaneously or only one of them is operated.

It is a further object of the present invention to provide a parallel operation compressor type refrigerating apparatus which allows a stable operation for a long period of time without the fear of seizure of relatively shifting parts of the compressors even if the capacities of the two compressors are selected to differ from each other.

It is a still further object of the present invention to provide a parallel operation compressor type refrigerating apparatus whereby it is possible to control the refrigeration capacity so as to vary in several stages.

In accordance with the present invention a parallel operation compressor type refrigerating apparatus having a first and a second compressor connected in parallel with each other by a pipe, each having its crankcase separated into a motor chamber and a compressing element chamber by a partition which is provided with a lubricant equalizing nonreturn valve allowing lubricant passage only from the motor chamber side to the compressing element chamber side is provided comprising a means provided at the end of a suction pipe of a refrigerating cycle system to separate the circulating refrigerating gas into a gas and a lubricant, a first branch pipe to supply a portion of the gas to the first compressor, a second branch pipe to supply the rest of the gas and the lubricant to the second compressor, a pressure and lubricant equalizing pipe connecting together the lubricant sinks formed in the compressing element chambers of the first and the second compressors, and a nonreturn valve mounted in the pressure and lubricant equalizing pipe so as to block the gas flow from the first compressor to the second compressor.

In a preferred embodiment of the present invention the means to separate the circulating refrigerant gas into gas and lubricant is formed by connecting the first and the second branch pipes with the suction pipe of the refrigerating cycle system at the upper and lower portions thereof, respectively.

In accordance with an advantageous feature of the present invention the pipe friction loss to which the gas is subjected during its passage through the first suction branch pipe is selected to be larger than or substantially equal to that to which the gas is subjected during its passage through the second suction branch pipe.

BRIEF DESCRIPTION OF THE DRAWING

Additional objects and advantages of the present invention will become apparent from the following detailed description and the accompanying drawing wherein a somewhat diagrammatical representation of an embodiment of the present invention is shown.

DESCRIPTION OF THE PREFERRED EMBODIMENT

Referring now to the single attached drawing, there are shown first and second semi-hermetically sealed type compressors 1 and 2 respectively, 1*a* and 2*a* indicating crankcases of the two compressors 1 and 2, respectively. In crankcases 1*a* and 2*a* are formed motor chambers 1*c* and 2*c* as well as compressing element chambers 1*d* and 2*d*, respectively, by partitions 1*b* and 2*b*, respectively. 1*e* and 2*e* as well as 1*f* and 2*f* respectively indicate motors and compressing elements contained in motor chambers 1*c* and 2*c* together with compressing element chambers 1*d* and 2*d*, respectively. 1*g* and 2*g* indicate crankshafts respectively connecting motors 1*e* and 2*e* with compressing elements 1*f* and 2*f*, 1*h* and 2*h* being pressure equalizing valves respectively mounted to partitions 1*b* and 2*b* at their upper portions, whereby valves 1*h* an 2*h* are adapted to be closed when the pressure within motor chambers 1*c* and 2*c* is considerably lower than that in compressing element chamber 1*d* and 2*d* as at the time of the start of compressor 1 or 2.

1*i* and 2*i* indicate lubricant nonreturn valves mounted in partition 1*b* and 2*b*, respectively, at their lower portions, allowing lubricant passage only from lubricant sink 1*j* or 2*j* formed respectively at the bottom of motor chamber 1*c* or 2*c* to lubricant sink 1*k* or 2*k* at the bottom of compressing element chamber 1*d* or 2*d*, respectively.

3 indicates a pressure and lubricant equalizing pipe in communication with compressing element chambers 1*d* and 2*d* of the two compressors 1 and 2, 4 being an element or nonreturn valve mounted in pressure and lubricant equalizing pipe 3 to block gas passage from compressing element chamber 1*d* of first compressor 1 to compressing element chamber 2*d* of second compressor 2. 5 is a suction pipe of a refrigerating cycle system connected to an evaporator (not shown), 6 a first suction branch pipe of first compressor 1 connecting the upper portion of suction pipe 5 with motor chamber 1*c* of first compressor 1, 7 a second suction branch pipe of second compressor 2 connecting the lower portion of suction pipe 5 with motor chamber 2*c* of second compressor 2, and 8 a common discharge pipe of the two compressors 1 and 2 connected to the evaporator (not shown) through a condenser, an expansion valve, etc. (also not shown) of the refrigerating cycle system. At this point it is to be noted that the connecting portions of first and second suction pipes 6, 7 with suction pipe 5 form a means to separate the refrigerant gas sucked by compressors 1 and/or 2 into a gas and a lubricant, to be fully described later.

The following is a description of the operation of the parallel compression type refrigerating apparatus in accordance with the present invention for which the constitution has so far been described.

Assuming that the two compressors 1 and 2 are in operation, it is usual that the lubricant contained in the circulating refrigerant in an amount of about 0.5% of the amount of the refrigerant returns to compressors 1 and 2 together with the evaporated refrigerant gas evaporated in the evaporator of the refrigerating cycle system through suction pipe 5. In this case most of the lubricant is separated by gravity to enter second suction branch pipe 7 of second compressor 2 as shown by dot-and-dash arrow in the drawing, passing through motor chamber 2*c* thereof, and is then supplied into compressing element chamber 2*d* thereof through lubricant equalizing nonreturn valve 2*i*. Since compressing element chambers 1*d* and 2*d* of compressors 1 and 2, respectively, have the pressures therein equalized by pressure and lubricant equalizing pipe 3, the lubricant in compressing element chamber 2*d* of second compressor 2 can also be supplied into compressing element chamber 1*d* of first compressor 1 through pressure and lubricant equalizing pipe 3 via nonreturn valve 4 so that a normal lubricating function takes place in compressor 1 also. As to the refrigerant gas as shown by the solid line arrows it is sucked by first and second compressors 1, 2 through first and second suction branch pipes 6 and 7, respectively. Next, assuming that first compressor 1 only is in operation, substantially only the refrigerant gas enters motor chamber 1*c* of first compressor 1 from suction pipe 5 through suction branch pipe 6, while the lubricant separated falls into second branch pipe 7 by its own weight. During its flow the refrigerant gas is subjected to a pressure decrease of a degree of about 200 mm Aq due to pipe friction. The pressure in compressing element chamber 1*d* is also decreased by the action of pressure equalizing differential pressure valve 1*h*. The substantial portion of the lubricant separated from the refrigerant gas in the manner described above flows by its own weight into compressing element chamber 2*d* of second compressor 2 from suction pipe 5 through second suction branch pipe 7, motor chamber 2*c*, and lubricant equalizing nonreturn valve 2*i* of second compressor 2. However, since second compressor 2 is not now in operation the friction loss to which the refrigerant gas is subjected during its passage through second suction branch pipe 7 is very small. Therefore, if the pressure P1*d* in compressing element chamber 1*d* of first compressor 1 is compared with the pressure P2*d* in compressing element chamber 2*d* of second compressor 2, the following inequality is derived:

$$P1d < P2d.$$

Owing to this pressure difference a portion of the lubricant accumulated in compressing element chamber 2*d* of second compressor 2 is delivered to compressing element chamber 1*d* of first compressor 1 through pressure and lubricant equalizing pipe 3 via nonreturn valve 4, which is adapted to allow the passage of the lubricant only in this sense.

Similarly, in the case where second compressor 2 only is in operation the refrigerant gas and the lubricant flow into compressing element chamber 2*d* of second compressor 2 from suction pipe 5 through second suction branch pipe 7 and motor chamber 2*c* of second compressor 2. In this case, during their passage through second suction branch pipe 7 the refrigerant gas and the lubricant have their pressure decreased about 200 mm Aq due to pipe friction. At this point, if it is assumed that pressure and lubricant equalizing pipe 3 were not provided with nonreturn valve 4, the refrigerant gas would flow into compressing element chamber 2*d* of second compressor 2 now in operation from first suction branch pipe 6 of first compressor 1 through motor chamber 1*c*, lubricant equalizing nonreturn valve 1*i*, compressing element chamber 1*d* of first compressor 1, and lubricant equalizing pipe 3, whereby the pressure within compressing element chamber 2*d* of second compressor 2 would be raised so that lubricant equalizing nonreturn valve 2*i* of second compressor would be closed, resulting in making it impossible to cause the lubricant returned to motor chamber 2*c* as explained earlier to be moved into compressing element chamber 2*d* of second compressor 2. Therefore, there would be the possibility of the occurrence of insufficient lubrication due to a shortage of lubricant within a relatively short period of time. In accordance with the present invention, since lubricant equalizing pipe 3 is provided with nonreturn valve 4 which may be adapted to be actuated at or above a predetermined pressure difference of the degree of say about 100 mm Aq, the gas in compressing element chamber 1*d* of first compressor 1 is prevented from entering compressing element chamber 2*d* of second compressor 2, the pressure in compressing element chamber 2*d* being maintained at substantially the same level as that in motor chamber 2*c* owing to the operation of pressure equalizing differential valve 2*h*. Accordingly, the lubricant returned to motor chamber 2*c* of second compressor 2 is made capable of being supplied to compressing element chamber 2*d*, so that second compressor 2 is assured of having the lubricant level in compressing element chamber 2*d* maintained always at a normal level even if it is continuously operated, allowing a stable continuous operation.

Thus it will be appreciated that in accordance with the present invention the lubricant levels in compressing chambers 1*d* and 2*d* of first and second compressors 1 and 2, respectively, are always maintained at normal levels, regardless of whether the two compressors 1 and 2 are operated simultaneously or independently.

Therefore, it is conceivable that when the capacities of first and second compressors 1 and 2 are different, e.g. 5 kw and 10 kw respectively, the possibility of capacity control in three stages will then be realized such as 33% of capacity with the operation of compressor 1 only, 67% with compressor 2 only, and 100% with both compressors. Thus, if the present invention is practiced as a refrigerating apparatus for cooling open display cases, etc. in food stores where a large load variation is expected, the capacity of the refrigerating apparatus can be controlled depending upon the load condition, making possible operation at an evaporating temperature near a designed condition and remarkably improving the efficiency of energy utilization.

The seasonal load variance of a general refrigerating apparatus lies in most cases between 40% and 100%. Therefore, if the capacities of first and second compressors 1 and 2 are selected to be small and large, respectively, although the operation ratio of the second compressor having a larger capacity may become high, even if it is assumed to be operated with a continuous back flow of the liquid due to e.g. a misadjustment of an expansion valve, since the liquid returns to the side of the second compressor in which the operation ratio is high and consequently heat generation of the motor is large, the influence of the liquid back flow is made small, the danger of occurrence of a malfunction due to it being suppressed.

Further, by changing the lengths of suction branch pipes 6 and 7 of first and second compressors 1 and 2, respectively, measured from the branching point of suction pipe 5 to the suction openings of compressors 1 and 2 so as to realize the following relationship: (friction loss of first suction branch pipe 6 of first compressor 1)≧(friction loss of second suction branch pipe 7 of second compressor 2), there arises a differential pressure between compressing element chambers 1*d* and 2*d* of first and second compressors 1 and 2, respectively, resulting in that while the two compressors 1 and 2 are operating simultaneously, a part of the lubricant returned to compressing element chamber 2*d* of second compressor 2, which is lying above the bottom surface of pressure and lubricant equalizing pipe 3, can be positively supplied to compressing element chamber 1*d* of first compressor 1 as excessive lubricant through pressure and lubricant equalizing pipe 3 via nonreturn valve 4 now held open, whereby the lubrication of the relatively shifting portions of both compressors 1, 2 is assured.

In general, due to the fluctuating capacitive relationship, etc. between compressors 1 and 2, it is difficult to equalize the pressures in compressing element chambers 1*d* and 2*d* of first and second compressors, respectively, over the whole evaporation temperature range of the refrigerating cycle system, and if the pressure within compressing element chamber 1*d* of first compressor 1 were higher than that within compressing element chamber 2*d* of second compressor 2, even slightly, the lubricant returned to second compressor 2 would not be able to flow into first compressor 1, causing a problem in lubrication, but in accordance with the present invention, since a pressure difference is caused to be positively built up between the two compressors 1 and 2 the lubricant supply from second compressor 2 to first compressor 1 can be smoothly carried out.

From the foregoing it will be appreciated that in accordance with the present invention it is made possible to maintain the lubricant levels appropriately in the two compressors regardless of an operation under a full capacity with the two compressors being in simultaneous operation or an operation under a partial capacity with either one of them being in operation, whereby a positive return to the compressors of the lubricant which is entrained in the refrigerant during the refrigerating cycle is assured. Therefore, the present invention can prevent the seizure of the relatively shifting portions of the compressors due to a shortage of lubricant, a decrease in refrigeration capacity due to a excess of lubricant content in the refrigerant, the damage of valve parts due to an excessive amount of lubricant, etc.

Although one embodiment of a parallel operation compressor type refrigerating apparatus has been described in detail herein, various changes may be made without departing from the scope of the present invention.

What is claimed is:

1. A parallel operation compressor type refrigerating apparatus comprising:

first and second compressors, each of said compressors having a partition in the crankcase thereof separating the crankcase in a motor chamber and a compressing element chamber, said partition having a pressure equalizing opening in the upper part thereof and a lubricant equalizing non-return valve in the lower part thereon in the lubricant sink in the lower part of the crankcase and allowing passage of lubricant only from said motor chamber into said compressing element chamber;

a suction pipe means adapted to conduct lubricant-containing refrigerant gas from a refrigeration cycle system to said compressor type refrigerating apparatus and having a separation means at its downstream end for separating the circulating lubricant-containing refrigerant gas into refrigerant gas and lubricant;

a first suction branch pipe means extending from said separation means to said first compressor for supplying a portion of the refrigerant gas to said first compressor;

a second suction branch pipe means extending from said separation means to said second compressor for supplying the remainder of the refrigerant gas and the separated lubricant to said second compressor;

a pressure and lubricant equalizing pipe means connecting the lubricant sinks of said compressing element chambers of said first and second compressors; and a non-return valve means in said pressure and lubricant equalizing pipe means for permitting flow of lubricant only from said second compressor to said first compressor.

2. A parallel operation compressor type refrigerating apparatus as claimed in claim 1 in which said separation means comprises a pipe connector connecting said first suction branch pipe means to said suction pipe means so as to extend upwardly therefrom and connecting said second branch pipe means so said suction pipe means so as to extend downwardly therefrom.

3. A parallel operation compressor type refrigerating apparatus as claimed in claim 1 in which the capacity of said first compressor is smaller than that of said second compressor.

4. A parallel operation compressor type refrigerating apparatus as claimed in claim 2 or claim 3 in which said first suction branch pipe means comprises means to give to the refrigerant gas passing therethrough a friction loss of $P_1$, and said second suction branch pipe means comprises means to give to the refrigerant gas passing therethrough a friction loss $P_2$, said friction losses being in the relationship of $P_1 \geqq P_2$.

* * * * *